US008579143B2

(12) United States Patent
Koshino

(10) Patent No.: US 8,579,143 B2
(45) Date of Patent: Nov. 12, 2013

(54) RESERVE TANK

(75) Inventor: Naoto Koshino, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 278 days.

(21) Appl. No.: 12/500,839

(22) Filed: Jul. 10, 2009

(65) Prior Publication Data

US 2010/0006577 A1 Jan. 14, 2010

(30) Foreign Application Priority Data

Jul. 10, 2008 (JP) ..... 2008-180148

(51) Int. Cl.
*B65D 1/24* (2006.01)
*F17C 1/00* (2006.01)
*E03B 11/00* (2006.01)

(52) U.S. Cl.
USPC ..... 220/509; 220/585; 137/571

(58) Field of Classification Search
USPC ..... 220/501, 585, 586, 86.2; 180/69.4; 280/830; 137/571, 574, 575, 576, 205, 137/423; 123/41.6, 41.61, 41.62; 134/60, 134/135
See application file for complete search history.

(56) References Cited

U.S. PATENT DOCUMENTS

| | | | | | |
|---|---|---|---|---|---|
| 1,080,547 | A | * | 12/1913 | Gamble | 137/423 |
| 1,202,050 | A | * | 10/1916 | Gamble | 137/205 |
| 2,920,784 | A | * | 1/1960 | Boardman | 220/565 |
| 3,520,329 | A | * | 7/1970 | Weber | 137/571 |
| 3,938,214 | A | * | 2/1976 | Hodsden et al. | 15/102 |
| 4,135,530 | A | * | 1/1979 | Cheney | 134/60 |
| 4,162,677 | A | * | 7/1979 | Gregory | 606/25 |
| 4,217,922 | A | * | 8/1980 | Come | 137/265 |
| 4,238,425 | A | * | 12/1980 | Matsuoka et al. | 261/81 |
| 4,431,027 | A | * | 2/1984 | Sabina, Jr. | 137/574 |
| 5,951,050 | A | * | 9/1999 | Siekmann | 280/830 |
| 6,293,420 | B1 | * | 9/2001 | Richter et al. | 220/563 |
| 2001/0036422 | A1 | * | 11/2001 | Lin et al. | 422/28 |

FOREIGN PATENT DOCUMENTS

| | | | | |
|---|---|---|---|---|
| JP | 50148430 | A | | 11/1975 |
| JP | 50148430 | A | | 12/1975 |
| JP | 2003286847 | A | * | 10/2003 |
| JP | 2004301084 | A | | 10/2004 |
| JP | 2005120906 | A | | 5/2005 |
| JP | 2007009752 | A | | 1/2007 |

* cited by examiner

*Primary Examiner* — Bryon Gehman
*Assistant Examiner* — Shawn Braden
(74) *Attorney, Agent, or Firm* — Gifford, Krass, Sprinkle, Anderson & Citkowski, P.C.

(57) ABSTRACT

Disclosed is a reserve tank comprising a tank main body that has a plurality of chambers partitioned by partition walls, an inflow port that allows coolant to flow into the tank main body, and an outflow port that allows the coolant to flow out of the tank main body, the plurality of chambers including a first chamber and a second chamber partitioned by the partition walls, and a third chamber that accumulates the coolant that should flow from the inflow port into the first chamber, the first chamber having a first communicating portion formed to allow the coolant to flow into the second chamber, the third chamber having a second communicating portion formed to allow the accumulated coolant to flow into the first chamber, the flow rate of the coolant passing through the second communicating portion being set smaller than the flow rate of the coolant passing through the first communicating portion.

7 Claims, 6 Drawing Sheets

RESERVE TANK

PRIORITY INFORMATION

This application claims priority to Japanese Patent Application No. 2008-180148, filed on Jul. 10, 2008, which is incorporated herein by reference in its entirety.

BACKGROUND OF THE INVENTION

1. Field of the Invention

The present invention relates to technology of a reserve tank used in a cooling system for cooling an object to be cooled.

2. Description of the Related Art

Auxiliary machines such as engines, motor generators, inverters, air compressors, and air-conditioning units provided on vehicles such as hybrid cars and electric cars generate heat at the time of driving. Vehicles such as hybrid cars and electric cars are provided with a cooling system for cooling with coolant to maintain proper temperature of heat-generating auxiliary machines (objects to be cooled).

FIG. 5 is a schematic diagram of a configuration of a typical cooling system. As shown in FIG. 5, a cooling system 2 includes a pump 58 that circulates coolant water, an inverter 60 (object to be cooled), a radiator 62 as a heat exchanger that causes heat exchange between the coolant water and ambient air, a reserve tank 64, and circulating paths 66*a*, 66*b*, 66*c*, and 66*d*.

Although the cooling system will be described in detail later, the pump 58 is operated to cause the heat exchange between the coolant water circulating the circulating paths 66*a*, 66*b*, 66*c*, and 66*d* (flow of the coolant water is represented by arrows shown in FIG. 5) and the inverter 60, to cool the inverter 60, which is the object to be cooled.

When the above cooling system 2 is operated, gas may mix into the coolant. Mixing the gas into the coolant causes deterioration of the heat exchange rate of the cooling system (substantially, the radiator 62) and abnormal noise and damage of the pump 58. Therefore, the reserve tank 64 having a gas-liquid separating ability is conventionally used to separate the gas in the coolant.

FIG. 6 is a schematic cross-section side view of a configuration of a typical reserve tank. As shown in FIG. 6, the reserve tank 64 has a tank main body 70, an entry tube 72, an exit tube 74, and a pressurizing cap 76 that adjusts the air pressure within the tank main body 70. The tank main body 70 has a plurality of chambers partitioned by a partition wall 78 and has a first chamber 82 provided with an inflow port 80 that allows the coolant to flow into the tank main body 70 and a second chamber 86 provided with an outflow port 84 that allows the coolant to flow out of the tank main body 70. A communicating portion 88 allowing the coolant to flow into the second chamber 86 is formed in the first chamber 82. The communicating portion 88 is a through-hole formed in the partition wall 78. The gas in the coolant may be separated when the inflow coolant from the inflow port 80 passes through the communicating portion 88.

For example, Japanese Patent Application Laid-Open Publication No. 2005-120906 proposes a reserve tank provided with an eddy suppressing means that constrains the occurrence of eddies in the coolant at the rear face of a partition wall adjacent to a through-hole formed in the partition wall to improve the air-liquid separating performance of the reserve tank.

For example, Japanese Patent Application Laid-Open Publication No. 2004-301084 proposes a reserve tank provided with a partition wall that partitions the inside of the tank into the inflow port side and the outflow port side within a height range at a position lower than the inflow port and higher than the upper end of the outflow port, and the partition wall is provided with a flow path that communicates the inflow port side and the outflow port side at a height including at least the upper end of the outflow port or higher, to improve the air-liquid separating performance of the reserve tank.

Recently, since the generated heat temperature of the object to be cooled is increased due to the higher power output of the object to be cooled (such as an inverter), a flow rate of coolant must be increased in the cooling system. Cooling systems increasingly employ an electric pump having excellent performance aspect (performance, controllability, and quietness) compared to conventional mechanical pumps. Therefore, a large amount of gas may mix into the coolant at the time of operation of the cooling system.

A liquid level (liquid level 90 shown in FIG. 6) of the coolant in the reserve tank may be tilted due to a traveling condition such as rapid start or sudden stop of a vehicle and a road surface condition such as an ascending road or a descending road. On this occasion, if the liquid level of the coolant becomes lower than the inflow port, etc., in the reserve tank, the inflow port, etc., present in the coolant are exposed to the air and the gas may mix into the coolant.

SUMMARY OF THE INVENTION

It is therefore the object of the present invention to provide a reserve tank capable of constraining the mixing of gas into the coolant.

According to a major aspect of the present invention there is provided a reserve tank comprising a tank main body that has a plurality of chambers partitioned by partition walls, an inflow port that allows coolant to flow into the tank main body, and an outflow port that allows the coolant to flow out of the tank main body, the plurality of chambers including a first chamber and a second chamber partitioned by the partition walls, and a third chamber that accumulates the coolant that should flow from the inflow port into the first chamber, the first chamber having a first communicating portion formed to allow the coolant to flow into the second chamber, the third chamber having a second communicating portion formed to allow the accumulated coolant to flow into the first chamber, the flow rate of the coolant passing through the second communicating portion being set smaller than the flow rate of the coolant passing through the first communicating portion.

In the reserve tank, the capacity of the third chamber is preferably smaller than the capacity of the first chamber.

In the reserve tank, from the viewpoint of tank molding, the second communicating portion is preferably formed between the partition wall partitioning the first chamber from the third chamber and a side wall of the tank main body.

According to the present invention, the mixing of gas into coolant may be constrained even when a liquid level of coolant is tilted due to a traveling condition, a road surface condition, etc., of a vehicle.

DETAILED DESCRIPTION OF THE PREFERRED EMBODIMENTS

An embodiment of the present invention will now be described.

Figure 1:
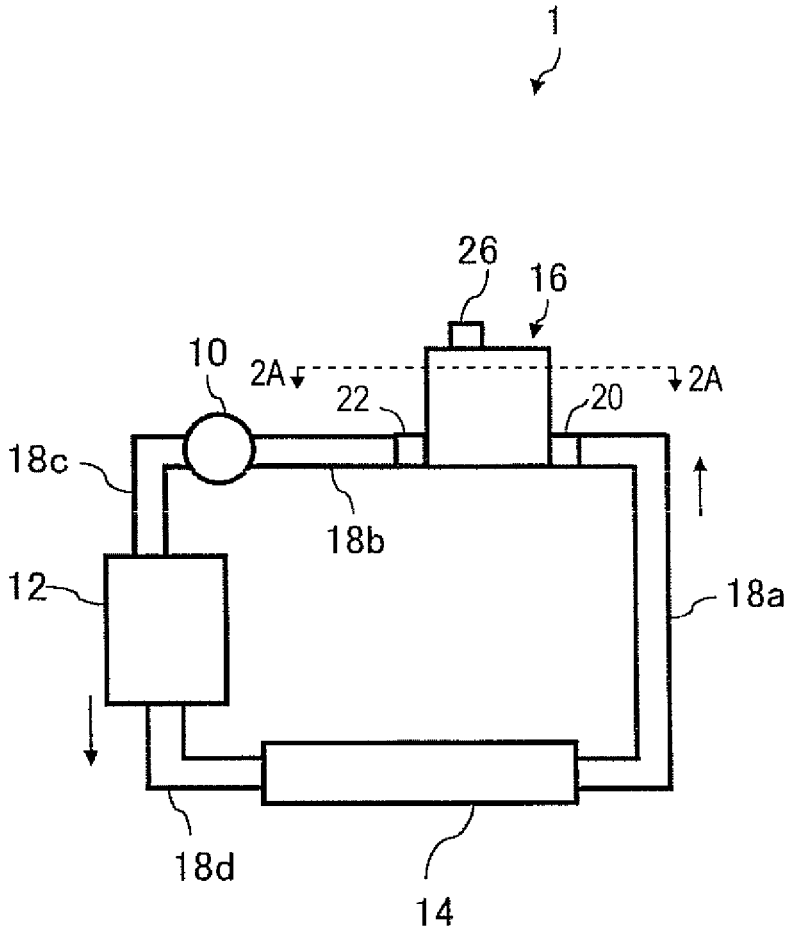
FIG. 1 is a schematic cross-section diagram of an example of a configuration of a cooling system according to an embodiment of the present invention.

FIG. 1 is a schematic cross-section diagram of an example of a configuration of a cooling system according to the embodiment of the present invention. As shown in FIG. 1, a cooling system 1 includes a pump 10 that circulates coolant, an inverter 12 as an object to be cooled, a radiator 14 as a heat exchanger that causes heat exchange between the coolant and ambient air, a reserve tank 16 that contains the coolant, and circulating paths 18*a*, 18*b*, 18*c*, and 18*d*.

The circulating path 18*a* connects a discharge port (not shown) of the radiator 14 with an entry tube 20 of the reserve tank 16; the circulating path 18*b* connects an exit tube 22 of the reserve tank 16 with the suction side (not shown) of the pump 10; the circulating path 18*c* connects the delivery side (not shown) of the pump 10 with a supply port (not shown) of the inverter 12; and the circulating path 18*c* connects a discharge port (not shown) of the inverter 12 with a supply port (not shown) of the radiator 14.

The operation of the cooling system 1 shown in FIG. 1 will be described. The coolant contained in the reserve tank 16 is supplied from the exit tube 22 of the reserve tank 16 through the circulating path 18*b* and the circulating path 18*c* to the inverter 12 due to the operation of the pump 10. The coolant supplied to the inverter 12 is discharged after exchanging heat with the heat-generating inverter 12 to cool the inverter 12. The discharged coolant is supplied through the circulating path 18*d* to the radiator 14. The supplied coolant is cooled by the heat exchange with the ambient air through the radiator 14 and discharged from the radiator 14. The discharged coolant is supplied through the circulating path 18*a* into the reserve tank 16 from the entry tube 20 of the reserve tank 16. The object to be cooled (e.g., the inverter 12) is cooled by circulating the coolant as above.

Figure 2A:
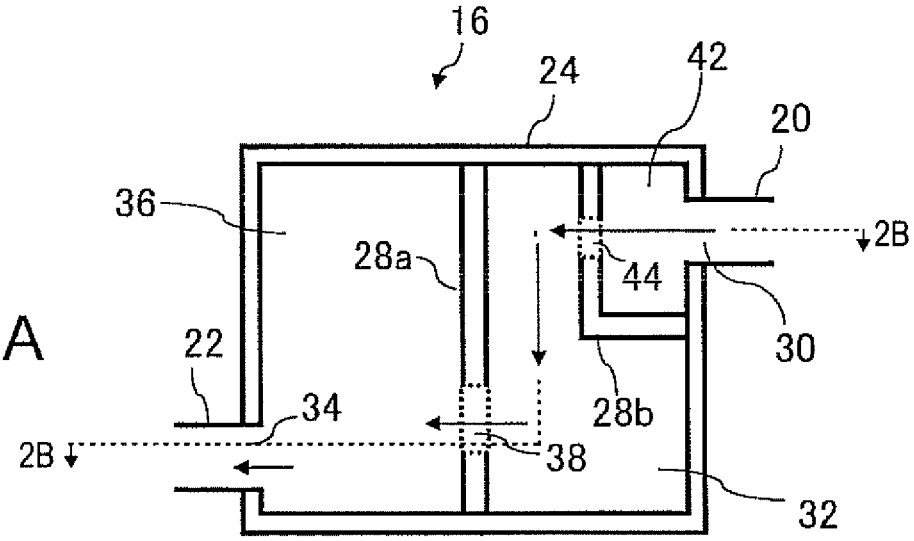
FIG. 2A is a schematic cross-section top view of a reserve tank taken along 2A-2A of FIG. 1 according to the embodiment.
Figure 2B:
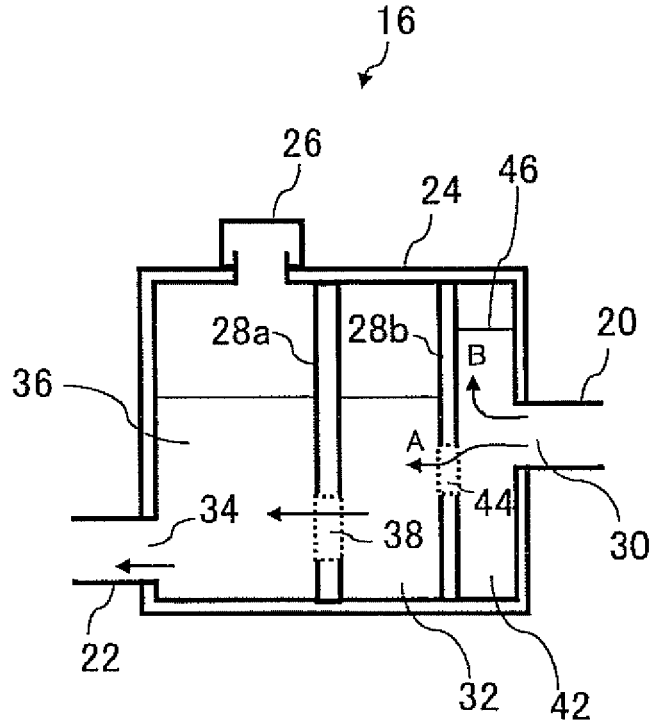
FIG. 2B is a schematic cross-section side view of the reserve tank taken along 2B-2B of FIG. 2A according to the embodiment.

FIG. 2A is a schematic cross-section top view of the reserve tank according to the embodiment and FIG. 2B is a schematic cross-section side view of the reserve tank according to the embodiment. As shown in FIGS. 2A and 2B, the reserve tank 16 has a tank main body 24, an entry tube 20, an exit tube 22, and a pressurizing cap 26. The pressurizing cap 26 adjusts the air pressure within the tank main body 24.

The tank main body 24 has a plurality of chambers partitioned by partition walls 28*a* and 28*b*. The plurality of chambers includes a first chamber 32, a second chamber 36, and a third chamber 42; the first chamber 32 and the second chamber 36 are partitioned by the partition wall 28*a;* and the first chamber 32 and the third chamber 42 are partitioned by the partition wall 28*b*. The third chamber 42 is provided with an inflow port 30 that allows the coolant to flow into the tank main body 24 and accumulates the coolant that should flow from the inflow port 30 into the first chamber 32. The second chamber 36 is provided with an outflow port 34 that allows the coolant to flow out of the tank main body 70. As shown in FIGS. 2A and 2B, the entry tube 20 communicates with the inflow port 30 and the exit tube 22 communicates with the outflow port 34.

In this embodiment, a partition wall may be further provided in the tank main body so as to form a plurality of chambers between the first chamber 32 and the second chamber 36 or after the second chamber 36.

A first communicating portion 38 allowing the coolant to flow into the second chamber 36 is formed in the first chamber 32. The first communicating portion 38 is a through-hole formed in the partition wall 28*a*. The coolant in the first chamber 32 moves through the first communicating portion 38 into the second chamber 36. A position, a size, etc., of the first communicating portion 38 are suitably set depending on a size, etc., of the reserve tank 16.

In this embodiment, a second communicating portion 44 allowing the accumulated coolant to flow into the first chamber 32 is formed in the third chamber 42. A size of the second communicating portion 44 is prescribed such that the flow rate of the coolant passing through the second communicating portion 44 is set smaller than the flow rate of the coolant passing through the first communicating portion 38. Since the above configuration generates a difference between the pressure loss of the coolant in the first chamber 32 and the pressure loss of the coolant in the third chamber 42, when the coolant flows from the inflow port 30 into the tank main body 24, the water level of the coolant in the third chamber 42 may be elevated higher than the water levels of the coolant in other chambers.

The coolant introduced through the inflow port 30 into the reserve tank with the above configuration passes through the third chamber 42 partitioned by the partition wall 28*b* and the second communicating portion 44 and moves into the first chamber 32 (an arrow A shown in FIG. 2B). If the third chamber 42 partitioned by the partition wall 28*b* does not exist and the coolant introduced through the inflow port 30 is directly supplied into the first chamber 32, waves are formed on the liquid surface in the first chamber 32 and cause the involvement of gas, and the gas is more easily mixed into the coolant. However, in this embodiment, the coolant is supplied to the third chamber 42 described above. When the coolant is supplied to the third chamber 42, the water level of the coolant in the third chamber 42 is elevated higher than the water levels of the coolant in other chambers as shown in FIG. 2B, and therefore a liquid surface 46 is stabilized. As a result, the involvement of gas may be constrained to prevent the gas from mixing into the coolant. Even when the liquid level 46 of the coolant in the reserve tank 16 is tilted due to a traveling condition such as rapid start or sudden stop of a vehicle and a road surface condition such as an ascending road or a descending road, the exposure of the inflow port 30 to the air in the third chamber 42 may be constrained to prevent the gas from mixing into the coolant since the water level in the third chamber 42 is elevated. Preventing the gas from mixing into the coolant may prevent the deterioration of the heat exchange rate of the cooling system and the occurrence of abnormal noise from the pump 10.

Although the capacity of the third chamber 42 is not particularly limited as long as the flow rate of the coolant passing through the second communicating portion 44 is smaller than the flow rate of the coolant passing through the first communicating portion 38, it is preferable to set the capacity of the third chamber 42 smaller than the capacity of the first chamber 32 in that the water level of the third chamber 42 may rapidly be elevated without affecting the water levels of other chambers. The capacity of the third chamber 42 is preferably ⅓ to ⅕ of the capacity of the first chamber 32. If the capacity of the third chamber 42 is greater than the above range, the water levels of other chambers may be reduced and sufficient air-liquid separating performance may not be realized. If the capacity of the third chamber 42 is smaller than the above range, the water level of the third chamber 42 is abruptly elevated and waves may be formed on the liquid surface and cause the involvement of gas. Since the third chamber 42 includes a portion of the flow of the coolant in the third chamber 42 forming a flow toward the air in the third chamber 42 (an arrow B shown in FIG. 2B), the air-liquid separating performance may be improved.

The coolant flows from the third chamber 42 to the first chamber 32 is discharged from the outflow port 34 through the first communicating portion 38 and the second chamber 36. A portion of the flow of the coolant in the first chamber 32 forms a flow smaller than that in the third chamber 42 toward the air in the first chamber 32.

Another embodiment of the present invention will hereinafter be described.

Figure 3:
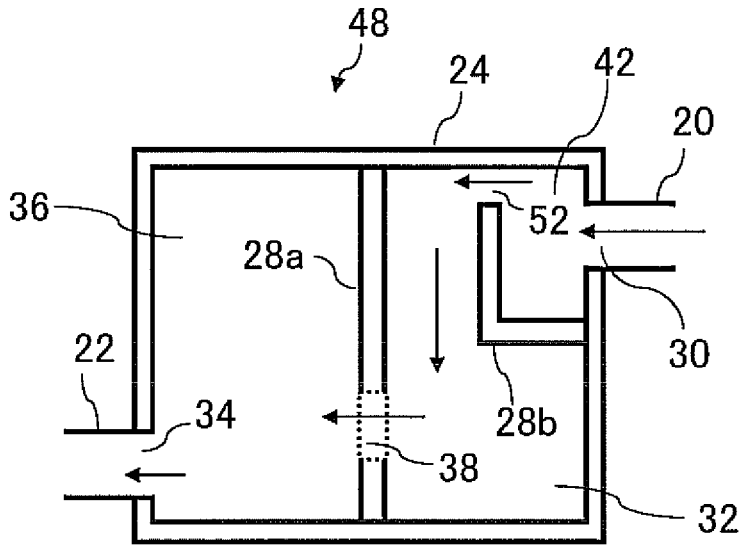
FIG. 3 is a schematic cross-section top view of another example of a configuration of the reserve tank according to the embodiment.

FIG. 3 is a schematic cross-section top view of another example of a configuration of a reserve tank according to the embodiment. The constituent elements of a reserve tank 48 shown in FIG. 3 that are the same as those of the reserve tank 16 shown in FIG. 2 are given the same reference numerals and will not be described.

In this embodiment, a second communicating portion 52 allowing the accumulated coolant to flow into the first chamber 32 is formed in the third chamber 42, and the second communicating portion 52 is formed between the partition wall 28*b* and a side wall of the tank main body 24. Although the second communicating portion 52 may be formed in a portion of an area between the partition wall 28*b* and the tank main body 24, the second communicating portion 52 is preferably formed in the entire area between the partition wall 28*b* and the tank main body 24 for ease of manufacturing. A size of the second communicating portion 52 is prescribed such that the flow rate of the coolant passing through the second communicating portion 52 is set smaller than the flow rate of the coolant passing through the first communicating portion 38 as above.

Figure 4A:
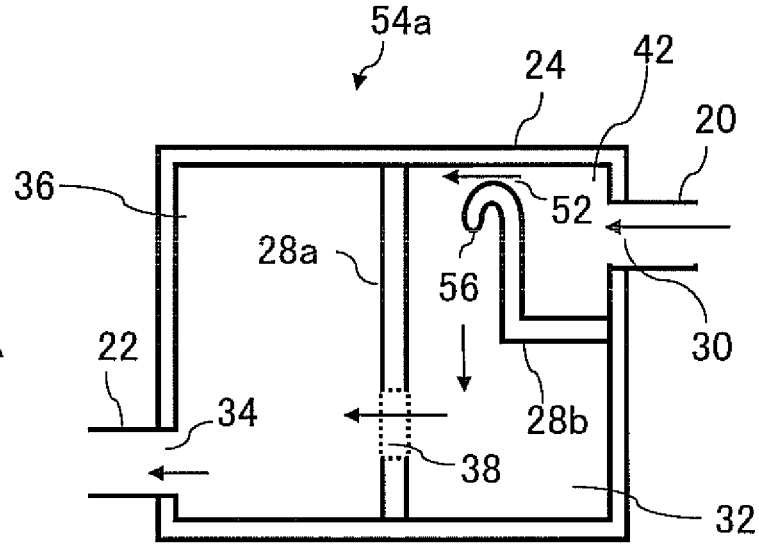
FIG. 4A is a schematic cross-section top view of another example of a configuration of the reserve tank according to the embodiment.
Figure 4B:
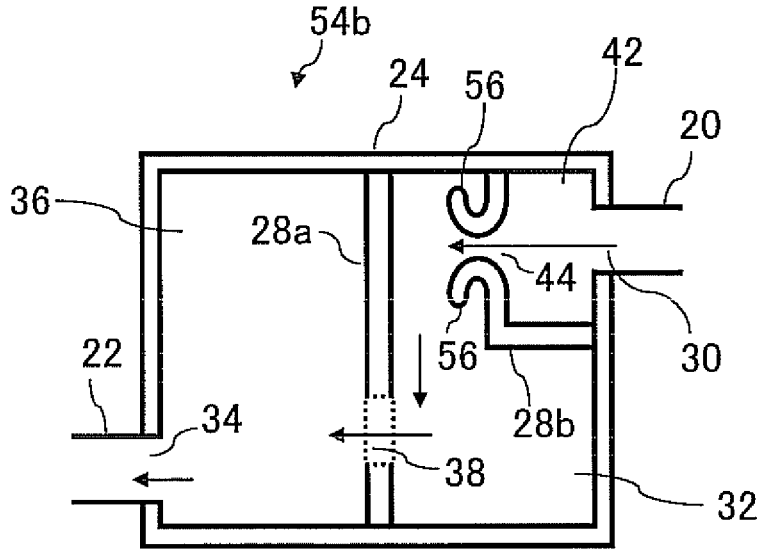
FIG. 4B is a schematic cross-section top view of another example of a configuration of the reserve tank according to the embodiment.
Figure 5:
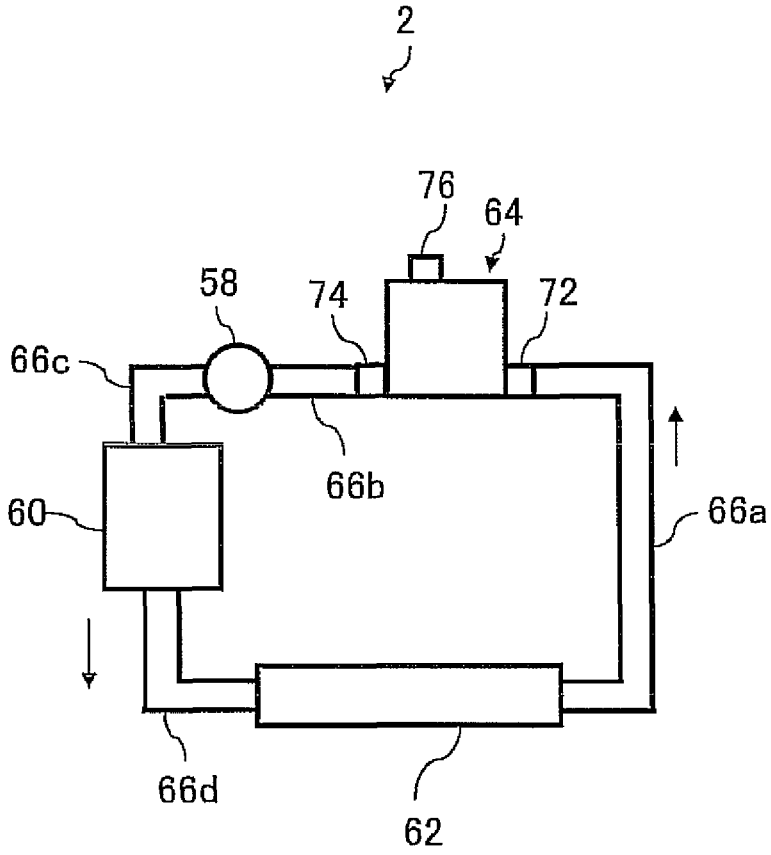
FIG. 5 Prior Art
FIG. 5 is a schematic diagram of a configuration of a typical cooling system.
Figure 6:
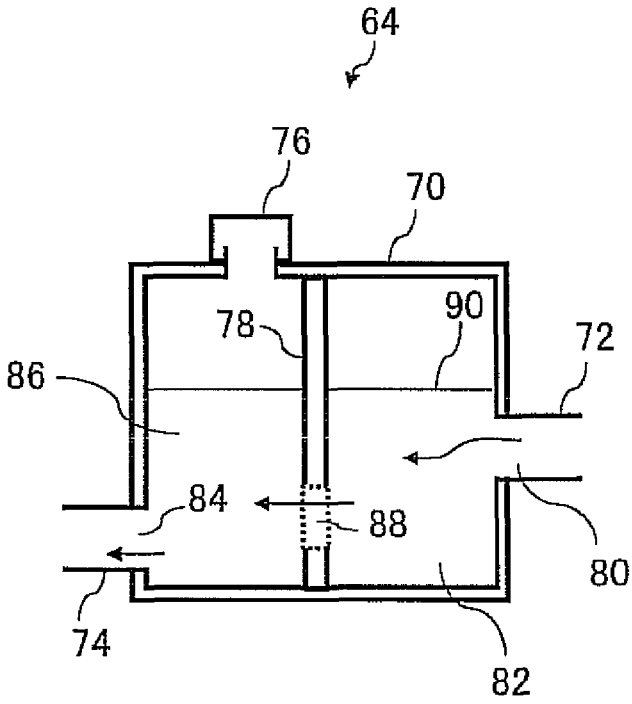
FIG. 6 Prior Art
FIG. 6 is a schematic cross-section side view of a configuration of a typical reserve tank.

FIGS. 4A and 4B are schematic cross-section top views of another example of a configuration of a reserve tank according to the embodiment. The constituent elements of a reserve tank 54*a* shown in FIG. 4A that are the same as those of the reserve tank 48 shown in FIG. 3 are given the same reference numerals and the constituent elements of a reserve tank 54*b* shown in FIG. 4B that are the same as those of the reserve tank 16 shown in FIG. 2 are given the same reference numerals and will not be described.

As shown in FIG. 4A, the partition wall 28*b* partitioning the first chamber 32 and the third chamber 42 has an R-shaped portion 56 bent into an arc shape from the second communicating portion 52 toward the first chamber 32. As shown in FIG. 4B, a pair of the R-shaped portions 56 may be provided from both sides of the second communicating portion 44 toward the first chamber 32. By providing the R-shaped portion 56 as above, the coolant passing through the second communicating portion (44, 52) forms a laminar flow, which may prevent the occurrence of an eddy. Therefore, the involvement of gas due to the occurrence of an eddy may be constrained. An R-shaped portion bent into an arc shape may be provided on the partition wall 28*a* in the same way from the first communicating portion 38 toward the second chamber 36.

Although the reserve tank of the embodiment has been described by taking a cooling system for an inverter to be cooled as an example, the reserve tank is not limited to the above description and may be those used with cooling systems for maintaining proper temperature of auxiliary machines such as engines, motor generators, air compressors, and air-conditioning units, for example. The pump 10 of the embodiment may be a mechanical pump, an electric pump, etc., and is not particularly limited.

As above, in the third chamber accumulating coolant that should flow from the inflow port into the first chamber in the reserve tank of the embodiment, the second communicating portion allowing the accumulated coolant to flow into the first chamber 32 is formed, and the water level of the coolant in the third chamber may be elevated higher than the water levels of the coolant in other chambers when the coolant flows from the inflow port into the tank main body by setting the flow rate of the coolant passing through the second communicating portion smaller than the flow rate of the coolant passing through the first communicating portion (allowing the coolant to flow from the first chamber to the second chamber). As a result, the liquid surface may be stabilized and the involvement of gas may be constrained. Even when the liquid level of the coolant in the reserve tank is tilted due to a traveling condition such as rapid start or sudden stop of a vehicle and a road surface condition such as an ascending road or a descending road, the exposure of the inflow port to the air may be constrained to prevent gas from mixing into the coolant since the water level of the coolant in the third chamber is elevated. By setting the capacity of the third chamber smaller than the capacity of the first chamber, the water level of the third chamber 42 may be rapidly elevated without affecting the water levels of other chambers.

What is claimed is:

1. A reserve tank comprising:

a tank main body that has a plurality of chambers partitioned by partition walls, an inflow port that allows coolant to flow into the tank main body, and an outflow port that allows the coolant to flow out of the tank main body, the plurality of the chambers including a first chamber and a second chamber partitioned by the partition walls, and a third chamber that is provided with the inflow port and the third chamber accumulates the coolant that flows from the inflow port, the first chamber having a first communicating portion formed to allow the coolant to flow into the second chamber, the third chamber having a second communicating portion formed to allow the accumulated coolant from the inflow port to flow into the first chamber, wherein the first communicating portion being dimensioned to have a first pressure loss of the coolant passing through the first communicating portion and a first flow rate of the coolant passing through the first communicating portion, and the second communicating portion being dimensioned to have a second pressure loss of the coolant passing through the second communicating portion and a second flow rate of the coolant passing through the second communicating portion, and wherein the second flow rate is smaller than the first flow rate and the second pressure loss is greater than the first pressure loss so as to generate a difference in a level of the coolant between the first chamber and the second chamber.

2. The reserve tank of claim 1, wherein a capacity of the third chamber is smaller than the capacity of the first chamber.

3. The reserve tank of claim 2, wherein the second communicating portion is formed between the partition wall partitioning the first chamber from the third chamber and a side wall of the tank main body.

4. The reserve tank of claim 2, wherein the capacity of the third chamber is within a range of ⅓ to ⅕ of the capacity of the first chamber.

5. The reserve tank of claim 1, wherein the second communicating portion is formed between the partition wall partitioning the first chamber from the third chamber, and a side wall of the tank main body.

6. The reserve tank of claim 1, wherein the partition wall partitioning the first chamber from the third chamber has an R-shaped portion formed and bent into an arc shape from the second communicating portion toward the first chamber.

7. The reserve tank of claim 1, wherein the partition wall partitioning the first chamber from the second chamber has an R-shaped portion formed and bent into an arc shape from the first communicating portion toward the second chamber.

* * * * *